US010704129B2

(12) United States Patent
Kuwagaki

(10) Patent No.: US 10,704,129 B2
(45) **Date of Patent: *Jul. 7, 2020**

(54) CU—NI—SI BASED ROLLED COPPER ALLOY AND PRODUCTION METHOD THEREOF

(71) Applicant: JX Nippon Mining & Metals Corporation, Tokyo (JP)

(72) Inventor: Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 15/083,554

(22) Filed: Mar. 29, 2016

(65) Prior Publication Data

US 2016/0289806 A1 Oct. 6, 2016

(30) Foreign Application Priority Data

Mar. 30, 2015 (JP) ..... 2015-069033
Mar. 9, 2016 (JP) ..... 2016-045525

(51) Int. Cl.
*C22C 9/06* (2006.01)
*C22F 1/08* (2006.01)

(52) U.S. Cl.
CPC . *C22F 1/08* (2013.01); *C22C 9/06* (2013.01)

(58) Field of Classification Search
CPC .... C22C 9/00; C22C 9/01; C22C 9/02; C22C 9/04; C22C 9/05; C22C 9/06; C22C 9/08; C22C 9/10; C22F 1/08
See application file for complete search history.

(56) References Cited

U.S. PATENT DOCUMENTS

| | | | |
|---|---|---|---|
| 9,859,031 | B2 | 1/2018 | Kuwagaki |
| 2005/0236074 | A1 | 10/2005 | Mihara et al. |
| 2011/0240180 | A1 | 10/2011 | Gao et al. |
| 2012/0241056 | A1 | 9/2012 | Sato et al. |
| 2014/0065441 | A1 | 3/2014 | Aoshima |
| 2015/0110668 | A1 | 4/2015 | Kuwagaki |

FOREIGN PATENT DOCUMENTS

| | | |
|---|---|---|
| EP | 2508635 | 10/2012 |
| EP | 2592164 | 5/2013 |
| JP | 2007-107037 | 4/2007 |
| JP | 4255330 | 4/2009 |

(Continued)

OTHER PUBLICATIONS

Notice of Allowance corresponding to U.S. Appl. No. 14/395,887 dated Oct. 3, 2017.

(Continued)

*Primary Examiner* — Colleen P Dunn
*Assistant Examiner* — Anthony M Liang
(74) *Attorney, Agent, or Firm* — Jenkins, Wilson, Taylor & Hunt, P.A.

(57) ABSTRACT

To provide a Cu—Ni—Si based rolled copper alloy having excellent strength, electric conductivity and fatigue properties, disclosed is a Cu—Ni—Si based rolled copper alloy, comprising: a total amount of 3.0 to 4.5% by mass of at least one or more selected from the group consisting of Ni and Co, 0.6 to 1.0% by mass of Si, and the balance Cu and inevitable impurities, wherein a 0.2% yield strength YS in a direction transverse to rolling direction is 1040 MPa or more.

4 Claims, 1 Drawing Sheet

(56) References Cited

FOREIGN PATENT DOCUMENTS

| | | | |
|---|---|---|---|
| JP | 2010-90408 | | 4/2010 |
| JP | 2011-012321 | | 1/2011 |
| JP | 2011-231393 | | 11/2011 |
| JP | 4830048 | | 12/2011 |
| JP | 4885332 | | 2/2012 |
| JP | 2017-179568 | | 10/2017 |
| KR | 20160102989 | A | 8/2016 |
| KR | 20160117210 | A | 10/2016 |
| WO | WO 2011/068134 | | 6/2011 |
| WO | WO 2013/161351 | | 10/2013 |

OTHER PUBLICATIONS

Official Action corresponding to U.S. Appl. No. 14/395,887 dated Apr. 4, 2017.

International Search Report corresponding to PCT/JP2013/053681 dated Mar. 19, 2013.

Notification of Transmittal of Translation of the International Preliminary Report on Patentability (Chapter I or Chapter II of the Patent Cooperation Treaty) corresponding to International Patent Application No. PCT/JP2013/053681 dated Nov. 6, 2014.

Technical Standard of Japan Copper and Brass Association JCBA T312, "Measuring Method for Factor of Bending Deflection by Cantilever for Copper Alloy Sheets, Plates and Strips," pp. 1-2 (2002).

Technical Standard of Japan Copper and Brass Association JCBA T308, "Measuring Method for Fatigue Property of Copper and Copper Alloy Thin Sheets, Plates and Strips," pp. 1-5 (2018).

Office Action corresponding to Korean Patent Application No. 10-2016-0034476 dated Nov. 10, 2017.

Written Opinion corresponding to Korean Patent Application No. 10-2016-0034476 dated Oct. 19, 2017.

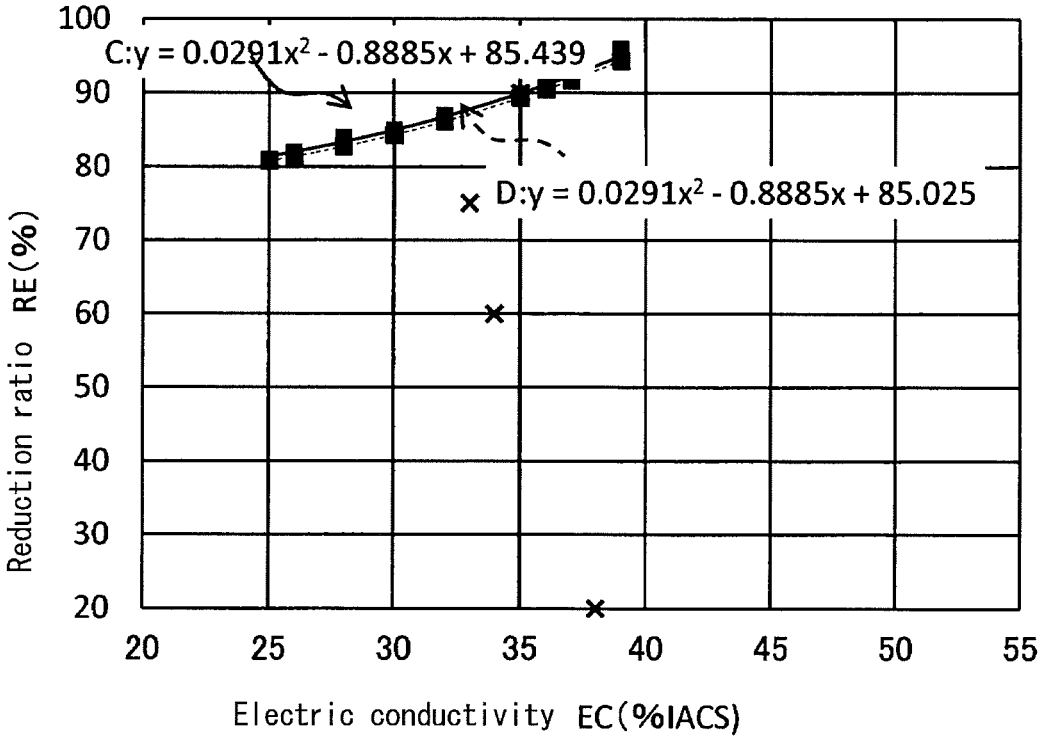
C:y = 0.0291x² - 0.8885x + 85.439
D:y = 0.0291x² - 0.8885x + 85.025
Reduction ratio RE(%)
Electric conductivity EC(%IACS)
100
90
80
70
60
50
40
30
20
20
25
30
35
40
45
50
55

CU—NI—SI BASED ROLLED COPPER ALLOY AND PRODUCTION METHOD THEREOF

CROSS-REFERENCE TO RELATED APPLICATIONS

The present U.S. patent application claims priority to Japanese Patent Application No. 2015-069033, filed Mar. 30, 2015 and Japanese Patent Application No. 2016-045525, filed Mar. 9, 2016, the disclosure of each of which is incorporated herein by reference in its entirety.

FIELD OF THE INVENTION

The present invention relates to a Cu—Ni—Si based rolled copper alloy and a production method thereof suitable for an electric conductive spring material such as a connector, a terminal, a relay and a switch.

DESCRIPTION OF THE RELATED ART

In the related art, a solution strengthening alloy such as brass and phosphor bronze has been used as a material for a terminal and a connector. Along with a reduction in a weight and a size of an electronic device, a terminal and a connector are thinned and miniaturized. A material used therefor needs high strength, a high bending property and excellent fatigue properties.

In particular, the fatigue properties required by the terminal and the connector include an improvement of a fatigue life at an area where a repeat count is relatively small and a repeated stress is high in an S-N curve. This corresponds to the case that the connector is designed to have a large displacement, i.e., a high stress, along with an increase of a low back type connecter.

In general, it is known that increasing strength of an alloy improves the fatigue strength. A Cu—Ni—Si based copper alloy (Colson alloy) having improved strength is developed by precipitation strengthening (Patent Literature 1). In addition, a Cu—Ni—Si based copper alloy having an increased fatigue life by adding a compressive residual stress to the alloy by rolling etc. to inhibit a generation of a fatigue crack (Patent Literature 2). Furthermore, a Cu—Ni—Si based copper alloy having an increased fatigue life by increasing a percentage of a Cube orientation {001}<100> to 5 to 50% to inhibit a generation of a crack (Patent Literature 3).

PATENT LITERATURE

[Patent Literature 1] International Publication WO 2011/068134 (Table 1)

[Patent Literature 2] Japanese Patent No. 4255330

[Patent Literature 3] Japanese Unexamined Patent Application Publication No. 2011-12321

SUMMARY OF THE INVENTION

Problems to be Solved by the Invention

However, there is a limitation that an increase in strength of the Cu—Ni—Si based copper alloy and an improvement of the fatigue strength therefrom. For example, although Patent Literature 1 describes that the strength (0.2% yield strength) of the Cu—Ni—Si based copper alloy is 1000 MPa at the maximum (Table 1 in Patent Literature 1), the strength exceeding the value is not acquired. An electronic material of a terminal and a connector is often perforated in its longitudinal direction in parallel with a direction transverse to rolling direction of a copper alloy strip. In this regard, an improvement of the strength in the direction transverse to rolling direction is important. The technology that focuses on this point cannot be seen.

The present invention is made to solve the above-described problems. An object thereof is to provide a Cu—Ni—Si based rolled copper alloy having excellent strength, electric conductivity and fatigue properties.

SUMMARY OF THE INVENTION

The present inventor found that it is important to improve strength at stress relief annealing, i.e., final annealing, in order to improve strength of a Cu—Ni—Si based rolled copper alloy in a direction transverse to rolling direction. To do so, it needs to increase a reduction ratio of cold rolling after aging just before the stress relief annealing as high as possible. As a minimum reduction ratio needed is changed depending on a degree of precipitation upon the cold rolling after the aging, the reduction ratio should be set depending on the degree of precipitation. Then, the present inventor succeeded that the strength of the alloy is improved stably by specifying the reduction ratio needed with a relational expression calculated from the electric conductivity using the electric conductivity in the direction transverse to rolling direction as an index for the degree of precipitation.

To achieve the above object, the present invention provides a Cu—Ni—Si based rolled copper alloy, comprising: a total amount of 3.0 to 4.5% by mass of at least one or more selected from the group consisting of Ni and Co, 0.6 to 1.0% by mass of Si, and the balance Cu and inevitable impurities, wherein a 0.2% yield strength YS in a direction transverse to rolling direction is 1040 MPa or more.

Preferably, the Cu—Ni—Si based rolled copper alloy further comprises a total amount of 0.005 to 2.5% by mass of one or more selected from the group consisting of Mg, Mn, Sn, Zn and Cr.

Preferably, the Cu—Ni—Si based rolled copper alloy further comprises a total amount of 0.005 to 1.0% by mass of one or more selected from the group consisting of P, B, Ti, Zr, Al, Fe and Ag.

Also the present invention provides a method of producing a Cu—Ni—Si based rolled copper alloy according to any one of claims 1 to 3, comprising hot rolling an ingot, which is then subjected to cold rolling, solution treatment, aging treatment, cold rolling after the aging, and stress relief annealing in this order, the ingot comprising: a total amount of 3.0 to 4.5% by mass of at least one or more selected from the group consisting of Ni and Co, 0.6 to 1.0% by mass of Si, further comprising a total amount of 0.005 to 2.5% by mass of one or more selected from the group consisting of Mg, Mn, Sn, Zn and Cr as necessary and/or comprising a total amount of 0.005 to 1.0% by mass of one or more selected from the group consisting of P, B, Ti, Zr, Al, Fe and Ag as necessary, and the balance Cu and inevitable impurities, wherein a reduction ratio RE of the cold rolling after the aging is set to 80% or more, electric conductivity EC (% IACS) in a direction transverse to rolling direction after the cold rolling after the aging and before the stress relief annealing is set to 25% or more to less than 40%, the reduction ratio RE is set to satisfy a numerical expression 1: $RE=>0.0291\times(EC)^2-0.8885\times(EC)+85.025$, and the stress relief annealing is carried out at 200 to 500° C. for 1 to 1000 seconds.

Effects of the Invention

According to the present invention, there can be provided a Cu—Ni—Si based rolled copper alloy having excellent strength, electric conductivity and fatigue properties.

BRIEF DESCRIPTION OF DRAWING

FIG. 1 A graph showing a correlation between electric conductivity in a direction transverse to rolling direction after cold rolling after aging and before stress relief annealing and a reduction ratio RE of cold rolling after aging.

DESCRIPTION OF THE EMBODIMENTS

Hereinafter, a Cu—Ni—Si based rolled copper alloy according to an embodiment of the present invention will be described. The symbol "%" herein refers to % by mass, unless otherwise specified.

(Composition)

[Ni, Co and Si]

The copper alloy includes a total amount of 3.0 to 4.5% of at least one or more selected from the group consisting of Ni and Co and 0.6 to 1.0% of Si. Ni, Co and Si form an intermetallic compound by a suitable heat treatment, and improve strength without degrading electric conductivity.

If the amount of Ni, Co and Si is less than the above-defined range, the strength cannot be improved. On the other hand, if the amount exceeds the above-defined range, electric conductivity is degraded, and hot workability is also degraded.

[Other Additional Elements]

The alloy may further include a total amount of 0.005 to 2.5% by mass of one or more selected from the group consisting of Mg, Mn, Sn, Zn and Cr.

Mg improves strength and a stress relaxation resistance. Mn improves strength and hot workability. Sn improves strength. Zn improves heat resistance at a solder joint. Cr forms a compound with Si similar to Ni, and improves strength by precipitation strengthening without degrading electric conductivity.

Furthermore, the alloy may include a total amount of 0.005 to 1.0% by mass of one or more selected from the group consisting of P, B, Ti, Zr, Al, Fe and Ag. If these elements are included, product properties such as electric conductivity, strength, a stress relaxation resistance, and plating property.

If the total amount of each element described above is less than the above-described range, the above-described effects may be provided. If the total amount exceeds the above-described range, electric conductivity may be degraded.

[Strength]

A 0.2% yield strength YS of the Cu—Ni—Si based rolled copper alloy in a direction transverse to rolling direction is 1040 MPa or more. When the strength of the alloy is increased, the fatigue strength is improved. So, when the YS is 1040 MPa or more, the fatigue strength is excellent. Here, as described above, a terminal and a connector require an improvement of a fatigue life at an area where a repeat count is relatively small and a repeated stress is high in an S-N curve. The present inventor found that the area is where the repeated stress (load stress) when the repeat count exceeds $10^4$ in the S-N curve is 750 MPa or more, and the YS satisfying the condition is 1040 MPa or more.

Accordingly, if the YS is less than 1040 MPa, the repeated stress when the repeat count exceeds $10^4$ in the S-N curve is decreased to less than 750 MPa, thereby degrading the fatigue properties.

The YS is determined by a tensile test according to JIS-Z2241.

The fatigue test is carried out according to JCBA-T308-2002.

<Production Method>

The Cu—Ni—Si based rolled copper alloy according to the present invention can be generally produced by hot rolling an ingot, which is then cold rolled, solution treated, aging-treated, cold rolled after the aging, and stress relief annealed in this order. The cold rolling before the solution treatment and recrystallization annealing are not essential, and may be carried out as necessary. Also, the cold rolling may be carried out after the solution treatment and before the aging treatment as necessary.

Here, the reduction ratio RE of the cold rolling after the aging is set to 81% or more. In order to improve the strength of the Cu—Ni—Si based rolled copper alloy in the direction transverse to rolling direction, it is important to improve the strength at the stress relief annealing, i.e., final annealing. For this, it needs to increase the reduction ratio of the cold rolling after the aging just before the stress relief annealing as high as possible. It is believed that when a strain at rolling is introduced into texture by the cold rolling after the aging, solution elements are adhered to the strain portion at the stress relief annealing thereafter and obstacles to dislocation increases the strength. Accordingly, if the reduction ratio RE is less than 81%, the strength of the alloy is not improved. The reduction ratio RE is a percentage (%) of a change in a thickness of the alloy before and after the cold rolling after aging.

Also, the minimum reduction ratio required is changed by a degree of precipitation strengthening (solid solution) of the alloy upon the cold rolling after aging. Therefore, the reduction ratio should be set depending on the degree of solid solution. As the degree of solid solution, the electric conductivity EC (% IACS) in the direction transverse to rolling direction after the cold rolling after the aging and before the stress relief annealing is used as an index. The reduction ratio required is specified by Equation 1 calculated from the electric conductivity. Thus, the strength of the alloy can be improved stably.

Here, by setting the electric conductivity EC (% IACS) to 25% or more to less than 40%, both conditions of the aging treatment and the stress relief annealing become adequate. By these treatments, the strength is increased, which leads to high strength. If the electric conductivity EC becomes 40% or more, the strength is increased by the aging treatment, but a solid solution amount is decreased. Therefore, if the reduction ratio RE is increased, the strength is not sufficiently increased by the stress relief annealing, and desired strength may not be provided. On the other hand, if the electric conductivity EC is less than 25%, the strength is increased by the stress relief annealing but is not increased by the aging treatment, and desired strength may not be provided.

The electric conductivity EC (% IACS) of a final product after the stress relief annealing is about 25 to 45%.

The higher the electric conductivity EC is, the lower the solid solution amount is. Then, in order to improve the strength required by the stress relief annealing, the reduction ratio RE should be much increased, thereby introducing much strain at rolling. It is preferable that the reduction ratio RE be set to satisfy the numerical expression 1: $RE=>0.0291\times(EC)^2-0.8885\times(EC)+85.025$. The numerical expression 1 is determined from experiments as shown in FIG. 1. Specifically, for each of Examples 1 to 17 described later, a relationship between the reduction ratio RE and the electric conductivity EC is plotted in FIG. 1. By a least-squares method, a quadratic curve C passing through the plot of each Examples 1 to 17 is found, thereby providing C: $RE=>0.0291\times(EC)^2-0.8885\times(EC)+85.439$. For Comparative Examples 8 to 10 where the condition of the reduction ratio RE is not included in the preferable range by the present invention, a relationship between the reduction ratio RE and the electric conductivity EC is similarly plotted in FIG. 1.

From FIG. 1, it is apparent that the range where the reduction ratio RE is higher than the quadratic curve C including no Comparative Examples 8 to 10 is preferable. Among the plots of Examples 1 to 17 in FIG. 1, the plot of Example 17 is furthest from the quadratic curve C to a y axis downward, and does not pass through the quadratic curve C. Then, when the quadratic curve C is translated in parallel with the y axis downward to provide a quadratic curve D through which the plot of Example 17 passes, a y intercept becomes 85.025. Accordingly, the numerical expression 1 is set to $RE=>0.0291\times(EC)^2-0.8885\times(EC)+85.025$.

If the reduction ratio RE does not satisfy the numerical expression 1, the reduction ratio RE is too small against the solid solution amount, and desired strength required by the stress relief annealing may not be provided.

Thereafter, the stress relief annealing is carried out at 200 to 500° C. for 1 to 1000 seconds. If a temperature of the stress relief annealing or an annealing time is less than the above-described range, the stress relief annealing becomes insufficient, and the strength is not improved by the stress relief annealing. If the temperature of the stress relief annealing or the annealing time exceeds the above-described range, the stress relief annealing becomes too much to soften the alloy, and the strength is not improved.

Examples

Electrolytic copper was melted in an air melting furnace, predetermined amounts of the additional elements shown in Table 1 were added thereto, and molten metals were agitated. Thereafter, the molten metals were tapped into a mold at a casting temperature of 1200° C. to provide each copper alloy ingot having the composition shown in FIG. 1. The ingot was hot-rolled to provide a rolled material. The rolled material was mechanical finished, which was subjected to first cold rolling, solution treatment, an aging treatment, cold rolling after the aging to provide a sample having a thickness of 0.2 mm. After the cold rolling after the aging, stress relief annealing was carried out under the conditions shown in Table 1.

The hot rolling was carried out at 1000° C. for three hours, and the aging treatment was carried out at 400° C. to 550° C. for one to 15 hours.

<Evaluation>

The resultant samples were evaluated for the following items.

[Electric Conductivity]

For a sample after the cold rolling after aging and before the stress relief annealing in the direction transverse to rolling direction and a final product sample after the stress relief annealing in the direction transverse to rolling direction, the electric conductivity (% IACS) for each was calculated from volume resistivity determined by a four-terminal method using a double bridge apparatus.

[Strength]

The final product after the stress relief annealing was pressed using a press machine so that a tensile direction is at the direction transverse to rolling direction to produce a JIS13B specimen. According to JIS-Z2241, a tensile test of the specimen was carried out to measure 0.2% yield strength. The tensile test was conducted under the conditions that a test specimen width was 12.7 mm; test temperature was room temperature (15-35 degree C.), the tension speed was 5 mm/min, and gauge length was 50 mm.

[Fatigue Test]

According to JCBA-T308-2002, a fatigue test under complete reversed plane bending was carried out. A strip sample having a width of 10 mm was taken so that a length direction of the sample was at the direction transverse to rolling direction. The test conditions were set to provide a relationship among a maximum stress (a) applied to a surface of the sample, an amplitude (f) and a distance (L) between a fulcrum and a stress action point as follows: $L=\sqrt{(3tEf/(2\sigma))}$ (t: sample thickness, E: Young's modulus measured according to JCBA-T312-2002). A load stress when the repeat count exceeded $10^4$ until the sample was broken was measured. The measurements were carried out four times, and an average value of the four times was determined.

Table 1 shows the results obtained. In Table 1, "0.5Zn" means that 0.5% by mass of Zn is included.

TABLE 1

| | Composition (mass %) | | | | Aging treatment | | Cold rolling after aging | |
|---|---|---|---|---|---|---|---|---|
| | | | | | Temperature | Time | Reduction ratio | Electric conductivity |
| No. | Ni | Co | Si | Others | (° C.) | (hr) | RE (%) | EC (% IACS) |
| Example 1 | 3.0 | — | 0.68 | 0.5Zn, 0.5Sn | 500 | 3 | 95 | 39 |
| Example 2 | 3.3 | — | 0.75 | | 500 | 3 | 96 | 39 |
| Example 3 | 3.3 | — | 0.75 | 0.1Mg | 500 | 3 | 92 | 37 |
| Example 4 | 3.3 | — | 0.75 | 0.1Mg, 1.0Zn, 0.5Sn | 500 | 3 | 90 | 35 |
| Example 5 | 3.5 | — | 0.64 | 0.5Sn, 0.5Zn | 500 | 3 | 90 | 35 |
| Example 6 | 3.5 | — | 0.64 | 0.1Mg | 500 | 3 | 90 | 35 |
| Example 7 | 3.8 | — | 0.80 | | 500 | 3 | 92 | 37 |
| Example 8 | 3.8 | — | 0.80 | 0.1Mg, 0.1Mn | 500 | 3 | 90 | 35 |
| Example 9 | 3.8 | — | 0.80 | 0.05Cr, 0.1Mg, 0.1Mn | 500 | 3 | 91 | 36 |
| Example 10 | 4.4 | — | 1.00 | | 500 | 3 | 82 | 26 |
| Example 11 | 2.0 | 1.0 | 0.70 | 0.1Cr | 500 | 3 | 95 | 39 |
| Example 12 | 3.0 | — | 0.68 | 0.01P, 0.01B, 0.01Ti, 0.01Zr, 0.01Al, 0.02Fe, 0.5Ag | 550 | 3 | 92 | 37 |
| Example 13 | 3.8 | — | 0.80 | 0.1Mg, 0.1Mn | 500 | 3 | 90 | 35 |
| Example 14 | 3.8 | — | 0.80 | 0.1Mg, 0.1Mn | 480 | 3 | 87 | 32 |

TABLE 1-continued

| | | | | | | | | |
|---|---|---|---|---|---|---|---|---|
| Example 15 | 3.8 | — | 0.80 | 0.1Mg, 0.1Mn | 450 | 3 | 85 | 30 |
| Example 16 | 3.8 | — | 0.80 | 0.1Mg, 0.1Mn | 420 | 3 | 84 | 28 |
| Example 17 | 3.8 | — | 0.80 | 0.1Mg, 0.1Mn | 400 | 3 | 81 | 25 |
| Comp. Example 1 | 2.3 | — | 0.20 | | 400 | 3 | 90 | 27 |
| Comp. Example 2 | 3.8 | — | 1.20 | | 500 | 3 | 85 | 22 |
| Comp. Example 3 | 1.1 | — | 0.26 | | 500 | 3 | 90 | 50 |
| Comp. Example 4 | 4.7 | — | 1.00 | | Stop due to crack generated by hot rolling | | | |
| Comp. Example 5 | 3.8 | — | 0.80 | 0.5Mg, 1.0Mn, 1.2Zn | 500 | 3 | 90 | 20 |
| Comp. Example 6 | 3.8 | 1.0 | 0.80 | 0.5Sn, 0.5Cr, 0.2Mg | 500 | 3 | 90 | 21 |
| Comp. Example 8 | 3.8 | — | 0.80 | 0.1Mg, 0.1Mn | 500 | 3 | 75 | 33 |
| Comp. Example 9 | 3.8 | — | 0.80 | 0.1Mg, 0.1Mn | 500 | 3 | 60 | 34 |
| Comp. Example 10 | 3.8 | — | 0.80 | 0.1Mg, 0.1Mn | 500 | 3 | 20 | 38 |
| Comp. Example 11 | 3.8 | — | 0.80 | 0.1Mg, 0.1Mn | 600 | 3 | 85 | 44 |
| Comp. Example 12 | 3.8 | — | 0.80 | 0.1Mg, 0.1Mn | 350 | 3 | 90 | 20 |
| Comp. Example 13 | 3.8 | — | 0.80 | 0.1Mg, 0.1Mn | 500 | 3 | 90 | 35 |
| Comp. Example 14 | 3.8 | — | 0.80 | 0.1Mg, 0.1Mn | 500 | 3 | 90 | 35 |

| | Stress relief annealing | | Final product | | |
|---|---|---|---|---|---|
| | | | | Electric conductivity | Repeated stress |
| No. | Temperature (° C.) | Time (sec) | YS (MPa) | EC (% IACS) | in fatigue test σ (MPa) |
| Example 1 | 250 | 1000 | 1050 | 39 | 750 |
| Example 2 | 300 | 100 | 1040 | 39 | 750 |
| Example 3 | 450 | 10 | 1060 | 37 | 800 |
| Example 4 | 400 | 30 | 1080 | 35 | 800 |
| Example 5 | 400 | 30 | 1080 | 35 | 850 |
| Example 6 | 400 | 30 | 1080 | 35 | 800 |
| Example 7 | 400 | 30 | 1040 | 37 | 800 |
| Example 8 | 400 | 30 | 1090 | 35 | 900 |
| Example 9 | 400 | 30 | 1050 | 36 | 750 |
| Example 10 | 400 | 30 | 1150 | 26 | 950 |
| Example 11 | 400 | 30 | 1060 | 39 | 800 |
| Example 12 | 400 | 30 | 1050 | 37 | 750 |
| Example 13 | 400 | 30 | 1120 | 35 | 900 |
| Example 14 | 400 | 30 | 1100 | 32 | 900 |
| Example 15 | 400 | 30 | 1070 | 30 | 850 |
| Example 16 | 400 | 30 | 1050 | 28 | 750 |
| Example 17 | 400 | 30 | 1040 | 25 | 750 |
| Comp. Example 1 | 400 | 30 | 600 | 27 | 500 |
| Comp. Example 2 | 400 | 30 | 1030 | 22 | 700 |
| Comp. Example 3 | 400 | 30 | 650 | 50 | 550 |
| Comp. Example 4 | Stop due to crack generated by hot rolling | | | | |
| Comp. Example 5 | 400 | 30 | 970 | 20 | 700 |
| Comp. Example 6 | 400 | 30 | 990 | 21 | 700 |
| Comp. Example 8 | 400 | 30 | 1030 | 33 | 700 |
| Comp. Example 9 | 400 | 30 | 1000 | 34 | 700 |
| Comp. Example 10 | 400 | 30 | 900 | 38 | 600 |
| Comp. Example 11 | 400 | 30 | 960 | 44 | 650 |
| Comp. Example 12 | 400 | 30 | 980 | 20 | 650 |
| Comp. Example 13 | 150 | 30 | 1000 | 35 | 700 |
| Comp. Example 14 | 550 | 30 | 960 | 36 | 650 |

As apparent from Table 1, in each of Examples where the 0.2% yield strength YS in the direction transverse to rolling direction is 1040 MPa or more, the repeated stress when the repeat count exceeds $10^4$ in the fatigue test is 750 MPa or more, and the fatigue properties are excellent.

On the other hand, in Comparative Example 1 where a total amount of Ni and Co is less than 3.1% and Comparative Example 3 where an amount of Si is less than 0.6%, precipitation strengthening by the elements is insufficient, thereby degrading the strength and the fatigue properties.

In Comparative Example 2 where an amount of Si exceeds 1.0%, the electric conductivity in the direction transverse to rolling direction after the cold rolling after the aging and before the stress relief annealing is decreased to less than 25% IACS, thereby degrading the strength and the fatigue properties.

In Comparative Example 4 where a total amount of Ni and Co exceeds 4.5%, a crack is generated in the hot rolling, and no alloy is produced.

In Comparative Example 5 where a total amount of Mg, Mn, Sn, Zn, Co and Cr exceeds 2.5% and in Comparative Example 6 where a total amount of Ni and Co exceeds 4.5%, the electric conductivity in the direction transverse to rolling direction after the cold rolling after the aging and before the stress relief annealing is decreased to less than 25% IACS, thereby degrading the strength and the fatigue properties. In Comparative Example 6, a total amount of Ni and Co is too high similar to that in Comparative Example 4. However, it is believed that by adding one or more of Mg, Mn, Sn, Zn, Co and Cr, the hot workability is improved and no hot-rolled cracking is generated.

In each of Comparative Examples 8 to 10 where the reduction ratio RE of the cold rolling after the aging is less than 80%, the strength and the fatigue properties are degraded.

In Comparative Example 11 where the aging treatment temperature is higher than that in each Example, the aging treatment conditions are not suitable, the electric conductivity in the direction transverse to rolling direction after the cold rolling after the aging and before the stress relief annealing exceeds 40% IACS, and the strength and the fatigue properties are degraded.

In Comparative Example 12 where the aging treatment temperature is lower than that in each Example, the aging treatment conditions are not suitable, the electric conductivity in the direction transverse to rolling direction after the cold rolling after the aging and before the stress relief annealing is decreased to less than 25% IACS, and the strength and the fatigue properties are degraded.

In Comparative Example 13 where the aging temperature is less than 200° C., the stress relief annealing becomes insufficient. As the strength is not improved by the stress relief annealing, the strength and the fatigue properties are degraded.

In Comparative Example 14 where the aging temperature exceeds 500° C., the stress relief annealing becomes excessive, and the alloy is softened. As the strength is not improved, the strength and the fatigue properties are degraded.

FIG. 1 shows a correlation between the electric conductivity EC (% IACS) in the direction transverse to rolling direction after the cold rolling after the aging and before the stress relief annealing and the reduction ratio RE of the cold rolling after the aging in each of Examples and Comparative Examples. As described above, the numerical expression 1: $RE=>0.0291\times(EC)^2-0.8885\times(EC)+85.025$ was determined. By setting the reduction ratio RE to satisfy the numerical expression 1, the stress relief annealing is preferably sufficiently improved.

What is claimed is:

1. A rolled copper alloy, comprising: a total amount of 3.0 to 4.5% by mass of at least one or more selected from the group consisting of Ni and Co, 0.6 to 1.0% by mass of Si, a total amount of 2.5% or less by mass of one or more selected from the group consisting of Mg, Mn, Sn, Zn, and Cr, and the balance Cu and inevitable impurities, wherein a 0.2% yield strength YS in a direction transverse to rolling direction is 1040 MPa or more, and a repeated stress σ in a fatigue test when a repeat count exceeds $10^4$ is 750 MPa or more, wherein the fatigue test is carried out under complete reversed plane bending according to JCBA-T308-2002 and a strip sample having a width of 10 mm is taken so that a length direction of the sample is at the direction transverse to rolling direction, and test conditions are set to provide a relationship among a maximum stress $\sigma_m$ applied to a surface of the sample, an amplitude f described in mm and a distance L described in mm between a fulcrum and a stress action point as follows: $L=\sqrt{(3tEf/(2\sigma m))}$, where t is a sample thickness described in mm and E is a Young's modulus described in MPa measured according to JCBA-T3312-2002, and further wherein an electric conductivity EC (% IACS) in the direction transverse to rolling direction is 26% or more to 39% or less.

2. The rolled copper alloy according to claim 1, comprising a total amount of 0.005 to 2.5% by mass of one or more selected from the group consisting of Mg, Mn, Sn, Zn and Cr.

3. The rolled copper alloy according to claim 1, further comprising a total amount of 0.005 to 1.0% by mass of one or more selected from the group consisting of P, B, Ti, Zr, Al, Fe and Ag.

4. The rolled copper alloy according to claim 2, further comprising a total amount of 0.005 to 1.0% by mass of one or more selected from the group consisting of P, B, Ti, Zr, Al, Fe and Ag.

* * * * *